US005722761A

United States Patent [19]

Knight

[11] Patent Number: 5,722,761

[45] Date of Patent: Mar. 3, 1998

[54] LAMP ASSEMBLY WITH FILTER PRODUCING VARIABLE PROPORTIONS OF ULTRAVIOLET AND INFRARED RADIATION

[75] Inventor: Ronald Edward Knight, Berkshire, England

[73] Assignee: Nordson Corporation, Westlake, Ohio

[21] Appl. No.: 656,947

[22] Filed: Jun. 6, 1996

[51] Int. Cl.[6] ..... F21V 29/00; F26B 3/28

[52] U.S. Cl. ..... 362/96; 362/218; 362/294; 34/276; 34/277; 34/278; 34/4

[58] Field of Search ..... 362/96, 218, 318, 362/319, 320, 321, 322, 323, 324, 294; 34/4, 276, 277, 278; 240/47; 250/492.1, 504 R, 527; 315/240

[56] References Cited

U.S. PATENT DOCUMENTS

| | | | |
|---|---|---|---|
| 3,733,709 | 5/1973 | Bassemir et al. | 34/277 |
| 3,745,307 | 7/1973 | Peek, Jr. et al. | 34/278 |
| 3,819,929 | 6/1974 | Newman | 362/218 |
| 3,831,289 | 8/1974 | Knight | 34/278 |
| 3,914,594 | 10/1975 | Helding | 362/218 |
| 4,000,407 | 12/1976 | Keller et al. | 240/47 |
| 4,005,135 | 1/1977 | Helding | 362/218 |
| 4,143,278 | 3/1979 | Koch, II | 250/527 |
| 4,177,383 | 12/1979 | Knight | 250/492.1 |
| 4,222,177 | 9/1980 | Mason | 362/318 |
| 4,563,589 | 1/1986 | Scheffer | 362/218 |
| 4,665,627 | 5/1987 | Wilde et al. | 34/4 |
| 4,864,145 | 9/1989 | Burgio, Jr. | 250/492.1 |
| 4,873,470 | 10/1989 | Myers | 315/240 |
| 4,948,980 | 8/1990 | Wedekamp | 250/504 R |
| 5,031,080 | 7/1991 | Aikens et al. . | |
| 5,094,010 | 3/1992 | Jacobi et al. | 362/218 |
| 5,168,302 | 12/1992 | Watanuki | 362/96 |
| 5,321,595 | 6/1994 | Jacobi et al. | 362/218 |

*Primary Examiner*—Ira S. Lazarus
*Assistant Examiner*—Matthew Spark
*Attorney, Agent, or Firm*—Rankin, Hill, Lewis & Clark

[57] ABSTRACT

A lamp assembly comprises an elongate lamp 1 which emits both ultraviolet and infrared radiation. The lamp is disposed within a reflective housing which serves to direct radiation from the lamp towards a moving substrate which is to be dried occurred. An infrared radiation filter is provided in the form of a quartz tube containing flowing water. The housing is provided with two reflector elements which can be pivoted about respective axes so as to enable the relative proportions of ultraviolet and infrared components in the radiation which emerges from the lamp assembly to be adjusted.

12 Claims, 2 Drawing Sheets

IN FULLY OPEN MODE APPROX 30% OF RADIATION UNFILTERED

IN PARTIALLY CLOSED MODE APPROX 6% OF RADIATION UNFILTERED

IN PARTIALLY CLOSED MODE
APPROX 6% OF
RADIATION UNFILTERED

IN FULLY OPEN MODE
APPROX 30% OF
RADIATION UNFILTERED

FULLY SHUTTERED

LAMP ASSEMBLY WITH FILTER PRODUCING VARIABLE PROPORTIONS OF ULTRAVIOLET AND INFRARED RADIATION

BACKGROUND OF THE INVENTION

The present invention relates to lamp assemblies and more particularly to lamp assemblies for use in the printing and coating industries for the fast drying or curing of inks and lacquers on a large variety of substrate materials. During the drying or curing process, the substrate is caused to move along a path such that successive strips of the substrate are irradiated by an elongate lamp assembly in a continuous process.

Such lamp assemblies typically use ultraviolet light generated by high-powered lamps in a reflector system.

Such systems, however, generate a considerable proportion of infrared energy, such as 60% of the total emitted radiation. Whilst this is generally beneficial in accelerating the curing process, the heat can be problematic in some applications where heat-sensitive materials are being handled.

A known solution to this problem is termed "water-filtration", wherein one or two tubes of quartz are typically provided between the lamp and the substrate and distilled deionized water passed through the tubes. This has the effect of filtering out approximately 50% of the infrared radiation.

One problem with this arrangement, however, is that some shortwave ultraviolet radiation is also filtered out, and this may therefore reduce the curing efficiency in some circumstances.

Where only heat-sensitive materials are being irradiated, the reduction in efficiency is an acceptable limitation, but users increasingly desire the flexibility to process a wide range of materials.

Furthermore, in many applications, such heat is only a problem when movement of the substrate commences, stops or when the substrate runs at low speeds.

A possible solution to this problem would be to provide removable water filter tubes or interchangeable reflector heads, but these are expensive and inconvenient and do not resolve the heat problems which occur during starting up and slowing down.

It would therefore be desirable to provide an arrangement which overcomes, or at least mitigates, the above-mentioned problems.

SUMMARY OF THE INVENTION

In accordance with a first aspect of the present invention there is provided a lamp assembly comprising a source of ultraviolet and infrared radiation, a directing device for directing a first proportion of the radiation through a filter and a second proportion so as to bypass the filter and a varying device for enabling at least one of the proportions to be varied so as thereby to control the relative amounts of ultraviolet and infrared radiation emerging from the assembly.

In accordance with a second aspect of the present invention there is provided a method of controlling the relative proportions of ultraviolet radiation and infrared radiation incident on a movable substrate in response to the sensed speed of movement of the substrate.

BRIEF DESCRIPTION OF THE DRAWINGS

In order that the features and advantages of the present invention will be fully appreciated, preferred embodiments thereof will now be described with reference to the accompanying drawings, wherein.

DETAILED DESCRIPTION OF THE PREFERRED EMBODIMENTS

Figure 1:
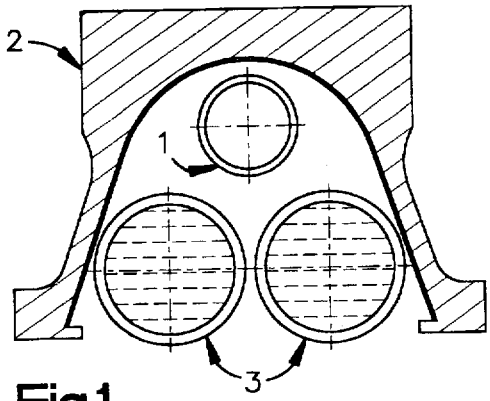
Fig.1 PRIOR ART
FIG. 1 illustrates in cross-section a conventional lamp assembly.
Figure 2:
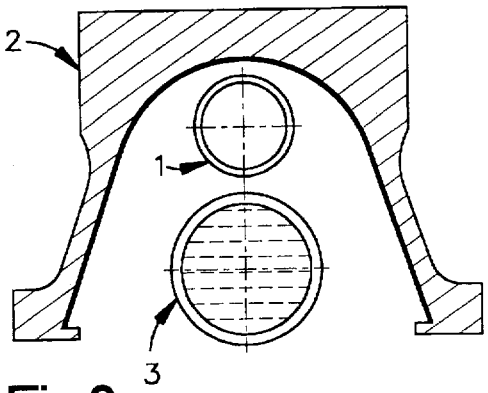
Fig.2 PRIOR ART
FIG. 2 illustrates in cross-section another conventional lamp assembly similar to FIG. 1 but with a single quartz tube.

Examples of conventional lamp assemblies are shown in FIGS. 1 and 2. In these arrangements an elongate ultraviolet lamp 1, which also emits infrared radiation is arranged within an elongate reflective housing 2 which functions as a directing device. One or more quartz tubes 3, through which distilled deionized water is passed, are also provided within the housing 2 such that a large proportion of the radiation from the lamp 1 passes through the water in the quartz tubes 3.

The water serves to filter out a substantial proportion of the infrared radiation which is emitted by the lamp 1.

Figure 3:
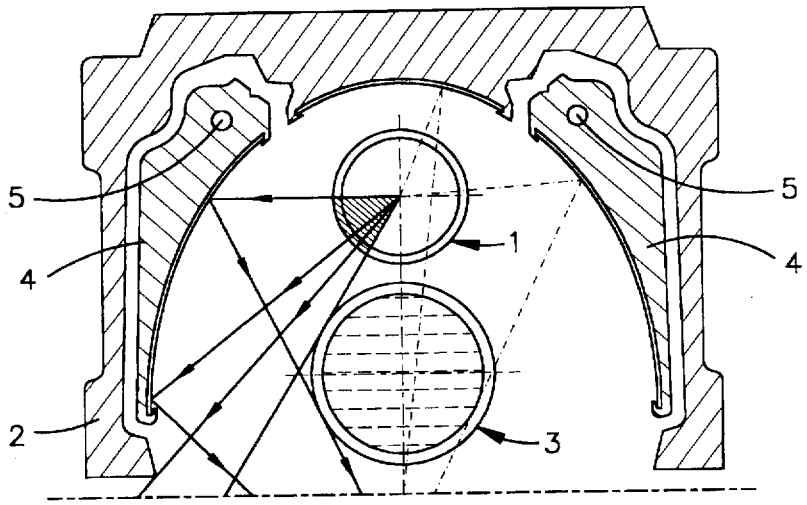
FIG. 3 illustrates in cross-section a first embodiment of the present invention with moveable reflectors shown in a first positions.
Figure 4:
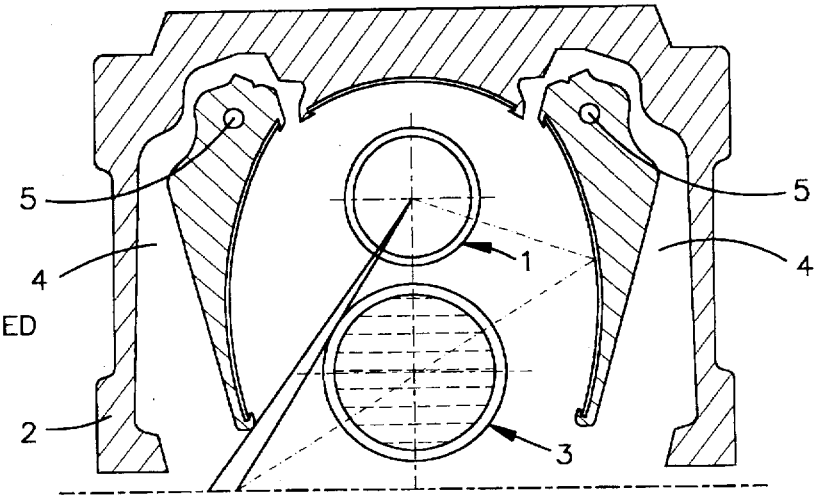
FIG. 4 illustrates in cross-section the first embodiment of the present invention similar to FIG. 3 with the moveable reflectors shown in a second position.

FIGS. 3 and 4 show a first embodiment of the present invention, which has the same components as those shown in FIGS. 1 and 2 represented by the same reference numerals. In this arrangement, varying devices in the form of two reflector elements 4 are pivotably mounted about respective axes 5. In the positions of these elements shown in FIG. 3, a large proportion of the radiation emitted by the lamp 1 emerges from the lamp assembly without passing through the water filter 3, such that the emergent radiation contains a relatively high proportion of infrared radiation.

In contrast, in the positions of the reflectors 4 shown in FIG. 4, a smaller proportion of the radiation emitted from the lamp 1 emerges unfiltered from the lamp assembly, for two reasons. Firstly, the positions of the reflectors 4 are such that only radiation emitted by the lamp 1 within a narrow angular range can bypass the filter 3. Secondly, the proportion of light reflected by the reflector elements 4 into the filter 3 is greater than in the situation shown in FIG. 3.

Figure 5A:
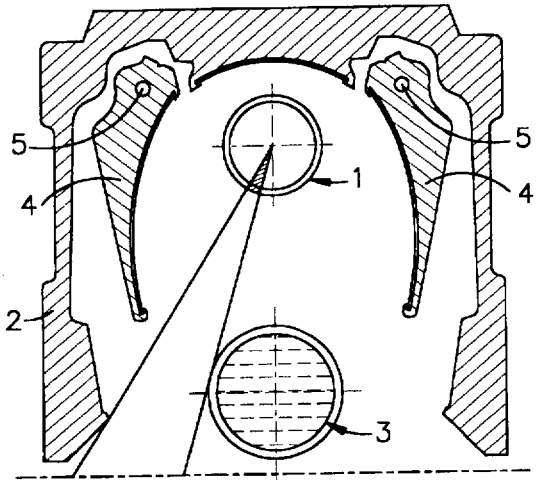
FIG. 5 illustrates in cross-section a second embodiment of the present invention, wherein movable reflectors are operable as a shutter device.
Figure 5B:
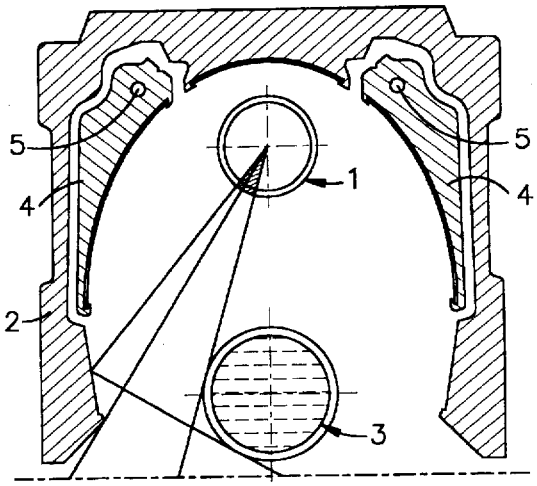
Figure 5C:
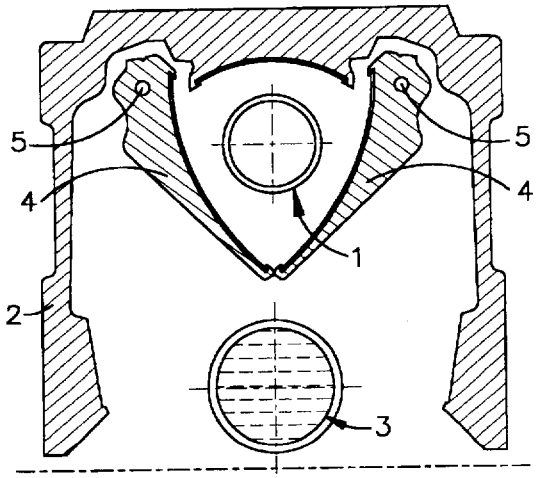

In a second embodiment, shown in FIG. 5, the quartz tube 3 is positioned further away from the lamp 1 than in the arrangement shown in FIGS. 3 and 4, and this enables the reflectors 4 to adopt a fully closed state which effectively prevents all of the radiation emitted by the lamp 1 from emerging from the lamp assembly.

In both of the above-described embodiments, the reflectors are moved by means of an electric motor (not shown). The positions of the reflectors 4 are sensed by a position sensor (not shown), and the sensor output is used to control the electric motor in a servo arrangement such that the reflectors 4 are always in the desired position.

Figure 6:
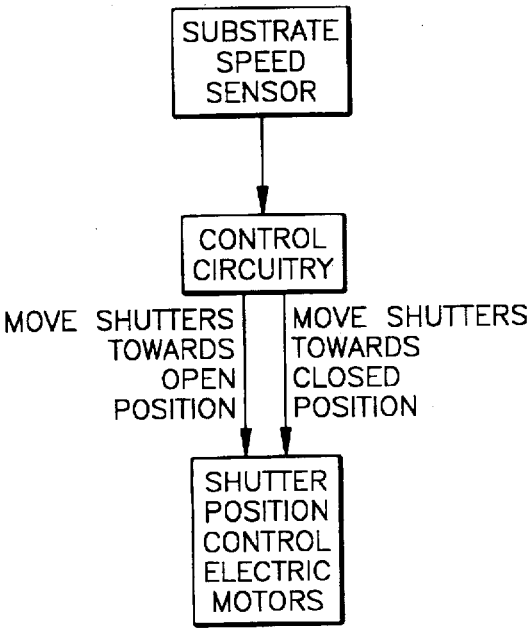
FIG. 6 illustrates a control system for the shutters.

The desired position of the reflectors 4 will in practice depend on the nature of the substrate being dried or cured and on the speed at which the substrate moves past the lamp assembly. Thus, in the arrangements described above, as shown in FIG. 6, a speed sensor is advantageously provided which generates an electrical output signal in dependence on the speed of the moving substrate and supplies this to control circuitry for controlling the electric motor. The resulting system will cause the reflectors 4 to adopt the position shown in FIG. 4 or FIG. 5(*a*) when the substrate is running at a low speed or when starting up or stopping, and, when running at full speed, the reflectors 4 will adopt the position shown in FIG. 3 or FIG. 5(*b*). Furthermore, when the apparatus is being used to dry or cure a heat-sensitive substrate, the partially closed mode shown in FIG. 4 and FIG. 5(*a*) would be adopted.

When the system is in an idling situation, the fully shuttered mode shown in FIG. 5(*c*) is adopted. Although preferred embodiments of the present invention have been described above, it will be clear to persons skilled in the art that a number of alternative arrangements would he possible without departing from the scope of the present invention. For example, although an electric motor is provided in the preferred embodiments for controlling the position of the reflectors, it would be possible to effect such control either manually or pneumatically. Furthermore, although the position of the reflectors is preferably sensed directly, it would be possible to deduce the position by measuring the infrared radiation emitted by the lamp assembly.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is inconsistent with the extent to which the progress in the art has been advanced by the invention.

What is claimed is:

1. A lamp assembly comprising a source of ultraviolet and infrared radiation, a filter, a varying device for directing a first proportion of the radiation through the filter and a second proportion so as to bypass the filter, the varying device being adjustably fixable in a plurality of settings enabling at least one of the proportions to be varied so as thereby to control the relative amounts of ultraviolet and infrared radiation emerging from the assembly.

2. A lamp assembly as claimed in claim 1, wherein the varying device comprises a movable optical element.

3. A lamp assembly as claimed in claim 1, wherein the varying device is operable as a shutter so as substantially to prevent radiation emerging from the lamp assembly.

4. A lamp assembly as claimed in claim 1, wherein the filter is an infrared filter.

5. Printing or coating apparatus comprising a lamp assembly as claimed in claim 1, wherein a substrate irradiated by the assembly is caused to move relative to the assembly, the apparatus further comprising a sensing device for sensing the speed of relative movement and for controlling the varying device in response thereto.

6. A lamp assembly as claimed in claim 2, wherein the optical element is a reflector.

7. A lamp assembly as claimed in claim 2, wherein the optical element is arranged to pivot about an axis.

8. A lamp assembly as claimed in claim 2, further comprising an electric motor for controlling the movement of the optical element.

9. A lamp assembly as claimed in claim 8, further comprising a controller for controlling the electric motor on the basis of a sensed condition.

10. A lamp assembly as claimed in claim 9, wherein the sensed condition is the position of the optical element.

11. A lamp assembly as claimed in claim 4, wherein the filter comprises water.

12. A method of controlling the relative proportions of ultraviolet and infrared radiation incident on a movable substrate comprising the steps of providing a source of ultraviolet and infrared radiation, directing a first proportion of the radiation through a filter, directing a second proportion so as to bypass the filter, sensing the speed of movement of the substrate, and positioning a varying device in one of a plurality of adjustably fixable settings to vary at least one of the proportions in response to the sensed speed of movement of the substrate so as thereby to control the relative amounts of ultraviolet and infrared radiation emerging from the assembly.

* * * * *

UNITED STATES PATENT AND TRADEMARK OFFICE
CERTIFICATE OF CORRECTION

PATENT NO : 5,722,761
DATED : March 3, 1998
INVENTOR(S) : Knight, Ronald Edward

It is certified that error appears in the above-identified patent and that said Letters Patent is hereby corrected as shown below:

Column 2, line 10, "positions" should be --position--.

Signed and Sealed this

Twenty-sixth Day of May, 1998

Bruce Lehman

*Attest:*

BRUCE LEHMAN

*Attesting Officer*

*Commissioner of Patents and Trademarks*